US008434203B2

(12) United States Patent
Morgan et al.

(10) Patent No.: US 8,434,203 B2
(45) Date of Patent: May 7, 2013

(54) BUCKLE WITH PIVOT PAWL AND NON-INTERLOCKING TONGUES

(75) Inventors: Philip D. Morgan, Noblesville, IN (US); Eugene R. Balensiefer, II, Tipton, IN (US)

(73) Assignee: Indiana Mills & Manufacturing, Inc., Westfield, IN (US)

( * ) Notice: Subject to any disclaimer, the term of this patent is extended or adjusted under 35 U.S.C. 154(b) by 0 days.

(21) Appl. No.: 13/187,856

(22) Filed: Jul. 21, 2011

(65) Prior Publication Data

US 2012/0011687 A1 Jan. 19, 2012

Related U.S. Application Data

(63) Continuation of application No. PCT/US2009/069039, filed on Dec. 21, 2009.

(60) Provisional application No. 61/147,195, filed on Jan. 26, 2009.

(51) Int. Cl.
*A44B 11/26* (2006.01)

(52) U.S. Cl.
USPC ..... 24/632; 24/637

(58) Field of Classification Search ..... 24/579.11, 24/593.1, 630–632, 637, 638, 647, 650; 297/468, 297/483, 484; 280/801.1, 808
See application file for complete search history.

(56) References Cited

U.S. PATENT DOCUMENTS

| | | | | |
|---|---|---|---|---|
| 3,639,948 | A * | 2/1972 | Sherman | 24/632 |
| 5,023,981 | A | 6/1991 | Anthony et al. | |
| 5,038,446 | A | 8/1991 | Anthony et al. | |
| 5,142,748 | A | 9/1992 | Anthony et al. | |
| 5,182,837 | A | 2/1993 | Anthony et al. | |
| 5,283,933 | A | 2/1994 | Wiseman et al. | |
| 5,406,681 | A | 4/1995 | Olson | |
| 5,813,097 | A | 9/1998 | Woellert et al. | |
| 6,868,591 | B2 | 3/2005 | Dingman et al. | |

FOREIGN PATENT DOCUMENTS

| | | | |
|---|---|---|---|
| EP | 0519296 | A1 | 12/1992 |
| WO | 2004-004507 | A1 | 1/2004 |
| WO | 2005-000063 | A1 | 1/2005 |

* cited by examiner

*Primary Examiner* — James Brittain
(74) *Attorney, Agent, or Firm* — Woodard, Emhardt, Moriarty, McNett & Henry LLP

(57) ABSTRACT

A web buckle 30 with a pivot pawl 40 to receive non-interlocking tongues insertable into the buckle. Push button 41 is biased upwardly by spring 39 within housing 44. Button 41 may be moved downward forcing pawl 40 to disengage the tongues. Pawl 40 is rockable to disengage the tongues one at a time.

18 Claims, 5 Drawing Sheets

BUCKLE WITH PIVOT PAWL AND NON-INTERLOCKING TONGUES

REFERENCE TO RELATED APPLICATIONS

This application is a continuation of PCT/US2009/069039, filed 21 Dec. 2009, which claims the benefit of U.S. Provisional Patent Application No. 61/147,195, filed 26 Jan. 2009, which are both incorporated by reference in their entireties.

BACKGROUND OF THE INVENTION

1. Field of the Invention

The present invention relates generally to the field of buckles having tongues inserted therein for connecting components, such as webs together.

2. Description of the Prior Art

In the commonly owned U.S. Pat. No. 6,868,591 there is disclosed an infant buckle having a pair of interlocking tongues releasably lockable with the buckle. The tongues are separate but have overlapping tab portions with aligned slots when inserted into the buckle to lockingly engage the buckle pivot pawl. The buckle is attached to a first web whereas the pair of tongues are attached to two additional webs thereby attaching the webs together when the tongues are inserted into the buckle. A push button actuator is operable to move the pawl allowing removal of the tongues from the buckle.

Buckles with interlocking tongues used in restraint systems are well known as shown in the commonly owned U.S. Pat. Nos. 5,023,981; 5,038,446; 5,142,748; 5,182,837; 5,283,933; and 6,868,591. Further, buckles with non-interlocking tongues used in restraint systems are also well known such as shown in the commonly owned U.S. Pat. No. 5,813,097. Non-interlocking tongues have the advantage that they may be inserted one at a time into the buckle or removed one at a time from the buckle. Each tongue of a pair of tongues are typically attached to a separate harness web. In the event the tongues are interlocking prior to insertion into the buckle, then a person must pull or control the routing of each web attached to each tongue during the insertion. Thus, an advantage is gained when inserting each tongue separately since the particular web attached to the tongue need only be pulled or controlled as compared to simultaneously dealing with both webs.

The locking pawls in the prior buckles typically include a plate with upraised portions to separately engage each tongue. The pawl is biased toward the tongue with the tongue first contacting the pawl during the insertion process and moving the pawl against a spring until the upraised portion of the pawl extends through a tongue aperture thereby releasably locking the tongue in place.

SUMMARY OF THE INVENTION

A buckle with non-interlocking tongues. The buckle has a locking pawl having an extension resting atop and pivotable up and down on a projection in the buckle housing. The pawl is rockable from side to side on the projection allowing insertion and removal of a tongue one at a time.

DESCRIPTION OF THE PREFERRED EMBODIMENT

Figure 1:
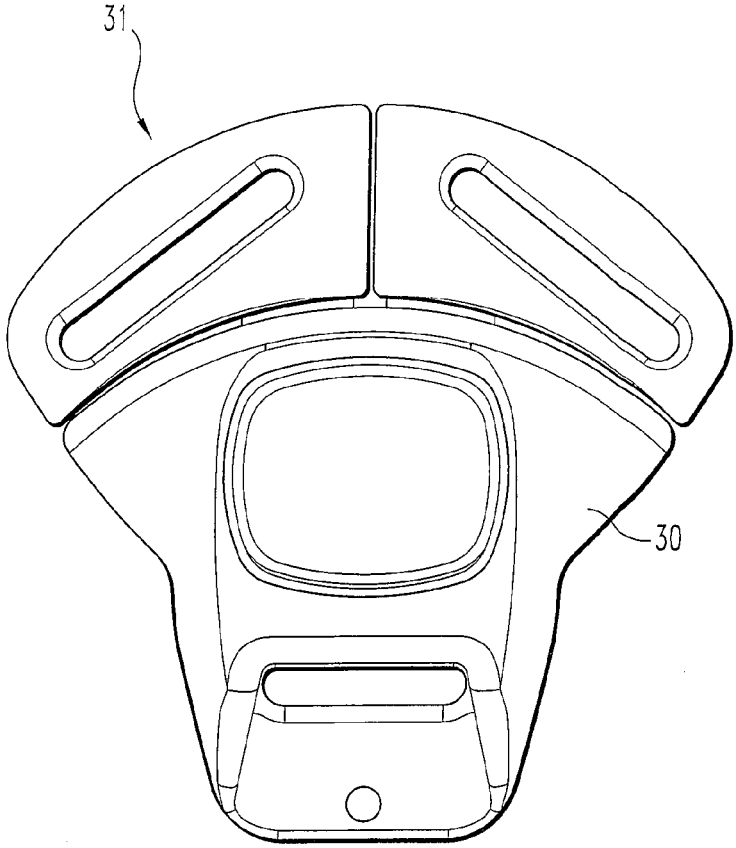
FIG. 1 is a plan view of a buckle with non-interlocking tongues incorporating the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to the drawings, a buckle 30 (FIG. 1) is shown having a pair of non-interlocking tongues 31 inserted in the buckle. The pair of tongues 31 include a first tongue 32 (FIG. 2) and second tongue 33. Each tongue has a main body 34 with a slot 35 extending lengthwise therein to allow insertion and mounting of a web to the main body. A metal tongue bar 36 is cantileverly mounted to main body 34 and extends outwardly away from the main body to extend through a tongue slot formed in the end of buckle 30. Tongue bar 36 includes an aperture 37 through which a buckle pawl projection extends to releasably lock the tongue bar to the pawl and thus the buckle. Aperture 37 is rectangular in configuration having an end 38 closest to main body 34 that is concave in shape. Main body 34 has a curved surface 39 facing buckle 30 that is complementary in shape to the outwardly convex surface of the buckle.

Buckle 30 (FIG. 3) includes a main body 44 having an upwardly opening cavity receiving a helical spring 39 that rests atop the bottom wall of main body 44 with the top end of the spring positioned beneath and in contact with pawl 40 resting there atop. A push button actuator 41 is fixedly mounted to pawl 40 and projects through opening 43 of buckle cover 42 fixedly mounted atop main body 44.

Figure 2:
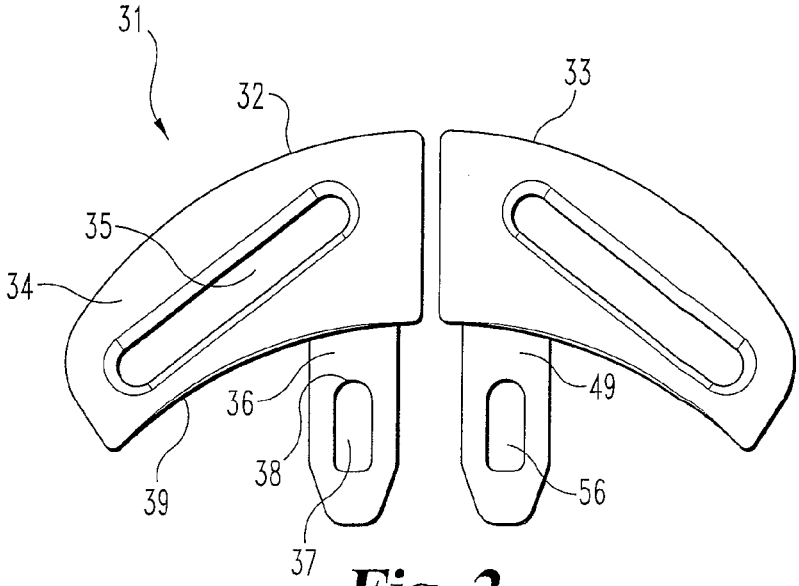
FIG. 2 is a plan view of the non-interlocking tongues removed from the buckle shown in FIG. 1.
Figure 3:
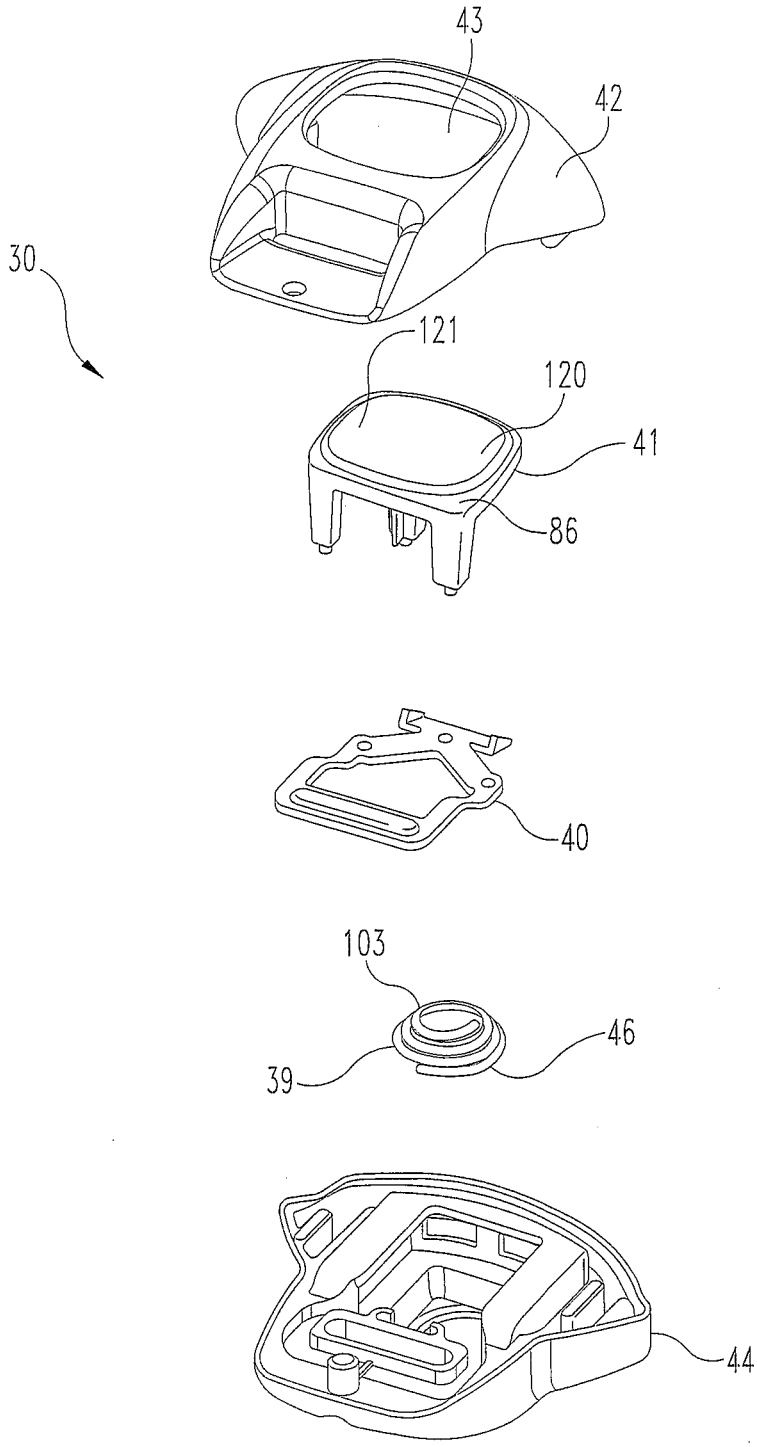
FIG. 3 is an exploded perspective view of the components of the buckle.

Main body 44 has an upwardly facing cavity 146 (FIG. 4) with a bottom wall having a circular recess 45 formed therein to receive the larger diameter end 46 of the coiled spring 39 (FIG. 3). The end wall of main body 44 has a pair of slots 47 and 48 that are rectangular in configuration to receive respectively the pair of tongue bars 36 and 49 (FIG. 2).

Figure 5:
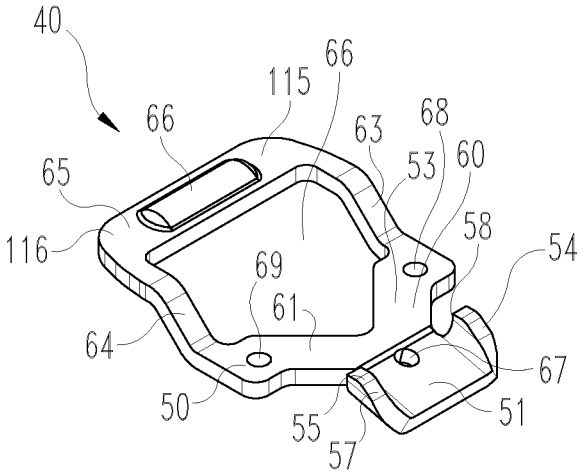
FIG. 5 is a perspective view of the pawl mounted within the buckle for releasably engaging the tongue.
Figure 6:
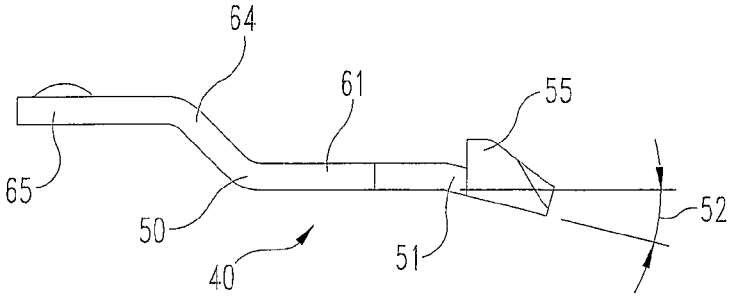
FIG. 6 is an enlarged side view of the pawl of FIG. 5.

Pawl 40 (FIG. 5) has a metal main body 50 with a distal end 51 integrally joined at an acute angle 52 to a flat portion 53 (FIG. 6) extending parallel to the bottom wall of buckle main body 31. A pair of upwardly extending projections 54 and 55 are sized to project through respectively apertures 37 and 56 (FIG. 2) of tongue bars 36 and 49.

Pawl flat portion 53 (FIG. 5) has a Y-shaped flat configuration as viewed from atop the pawl. Projections 54 and 55 extend upwardly from end 51 and have a downwardly sloping front edge 57 to engage the tongue bars as the tongue bars are inserted into slots 47 and 48. The distal ends of the tongue bars contact the sloping edge 57 of each projection forcing end 51 of the pawl downwardly until the projections 54 and 55 snap into and through apertures 37 and 56 of the tongue bars. The rearward edge 58 of each projection 54 and 55 are generally straight and non-sloping. A pair of upwardly extending arms 63 and 64 are integrally joined respectively to arms 60 and 61 with their opposite ends integrally joined to a cross member 65 forming an aperture 66 between flat portion 53, arms 63 and 64 and cross member 65. A convex ridge 66 is formed on the upwardly facing surface of cross member 65 and extends along the length thereof.

Three holes 67, 68, 69 are formed respectively in end 51, arm 60 and arm 61 to receive the downwardly extending bottom ends of legs integrally formed on the push button actuator 41.

Figure 7:
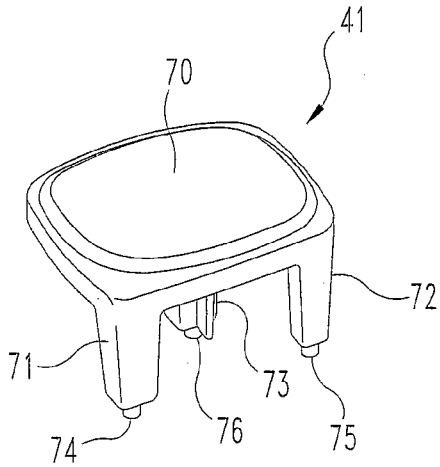
FIG. 7 is an enlarged perspective view of the push button pawl actuator.
Figure 8:
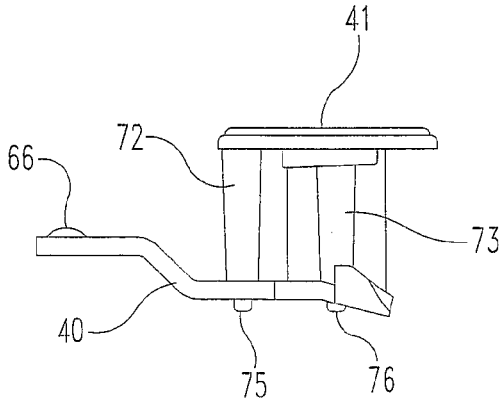
FIG. 8 is a side view of the actuator mounted to the pawl.

Actuator 41 (FIG. 7) has a solid main body 70 with three legs 71, 72 and 73 and integrally joined thereto and extending downwardly from the main body. Legs 71, 72 and 73 have respectively bottom ends 74, 75 and 76 extending through holes 68, 69 and 67 formed in pawl 40. The pawl is produced from metal whereas the push button actuator is produced from plastic. Bottom ends 74-76 are sized to extend through the pawl holes (FIG. 8) and project beneath the pawl with force applied to the bottom ends of the actuator plastically deforming the ends to swage the actuator legs to the pawl. Thus, the actuator and pawl are fixedly attached together and move in unison.

Figure 4:
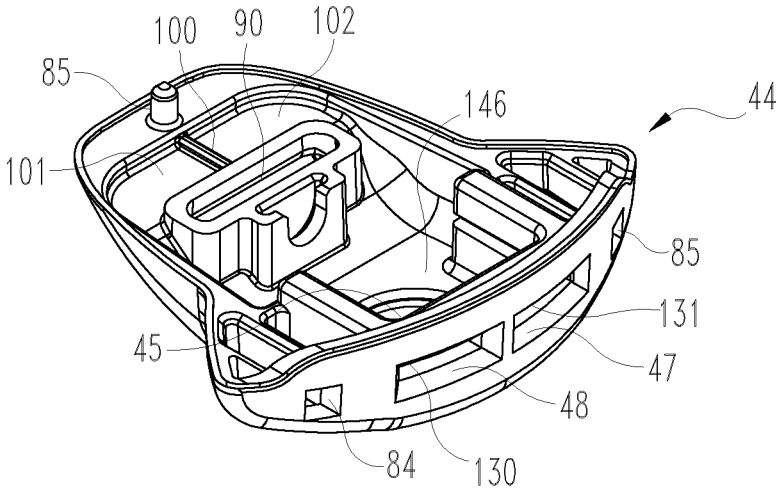
FIG. 4 is a perspective top view of the main body of the buckle.
Figure 9:
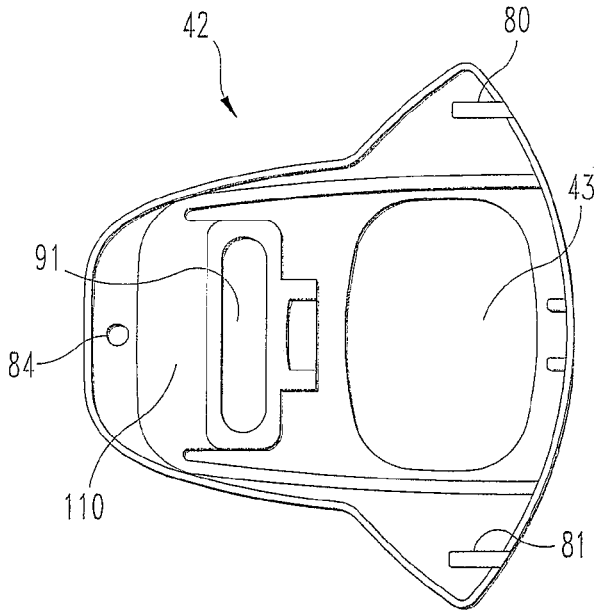
FIG. 9 is a bottom view of the buckle cover.
Figure 10:
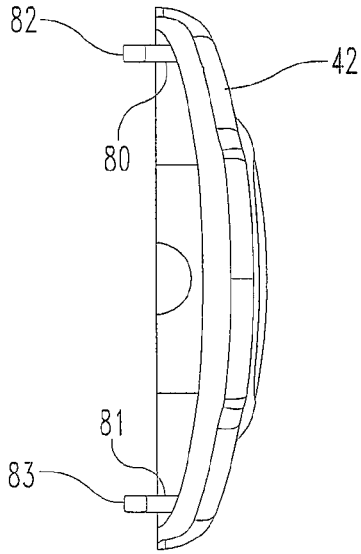
FIG. 10 is an end view of the buckle cover of FIG. 9.

Cover 42 (FIG. 9) has a pair of downwardly extending legs 80 and 81 with respectively forwardly extending distal ends 82 and 83 (FIG. 10) that extend into and through respectively apertures 84 and 85 formed in the forward wall of the buckle main body (FIG. 4). Further, cover 42 has a hole 84 through which pin 85 (FIG. 4) of the buckle main body extends. In order to install cover 42 to the buckle main body, distal ends 82 and 83 of legs 80 and 81 are extended through apertures 84 and 85 with the cover then being pivoted downward with pin 85 then passing through hole 84. The cover may then be joined to the buckle main body by any manner of conventional means such as by welding, adhesives, etc.

The outer circumferentially extending edge 86 (FIG. 3) of actuator 41 is recessed allowing the center upraised portion of the actuator to extend through aperture 43 of cover 42. The recessed edge portion 86 abuts the inwardly facing surface of the cover. The button may extend slightly above the cover or may be flush with the outer cover surface. In addition, the outwardly facing surface of the button may be slightly recessed to receive the thumb or finger of the person depressing the button.

Hole 90 (FIG. 4) forms a channel extending through the buckle main body and is aligned with hole 91 (FIG. 9) of cover 42 allowing a web to be extended through holes 90 and 91 to secure the buckle to the web.

A rib 100 extends in the direction of the length of the buckle main body with recesses 101 and 102 positioned on either side of the rib.

In order to assemble the components shown in FIG. 3, the spring 39 is first inserted into the buckle main body cavity positioning the larger diameter end 46 atop recess 45. Pawl 40 is then inserted into the buckle housing positioning cross member 65 (FIG. 5) atop rib 100 with the upraised portion 66 (FIG. 5) of the cross member facing upward. At the same time, flat portion 53 of the main body of the pawl is positioned atop and in contact with the smaller diameter end 103 (FIG. 3) of spring 39. Prior to insertion of the pawl into the buckle housing, the push button actuator 41 is fixedly mounted atop the pawl. Thus, by moving actuator 41 towards the bottom wall of the buckle main body, the spring is caused to compress moving the distal end 51 of the pawl downwardly to enable the tongue bars to be inserted through tongue slots 47 and 48. Cover 42 is installed atop the button with the distal ends of legs 80 and 81 inserted through slots 84 and 85 and with the top of the actuator being aligned with opening 43 of the cover. The cover is pivoted downward about legs 80 and 81 with pin 85 of the buckle main body extending through hole 84 of the cover with the cover and buckle main body then being fixedly joined together.

Cover 42 has a rear recess 110 positioned between opening 91 and hole 84. Recess 110 is aligned with and positioned over cross member 65 (FIG. 5) and upraised portion 66. In the event a single tongue bar is inserted into the buckle housing, the corresponding projection on the pawl is forced downwardly whereas the opposite projection moves upwardly tilting or pivoting the pawl since cross member 65 rests atop rib 100 causing one end portion of the cross member to pivot downward into either recess 101 or 102 whereas the opposite end portion of the cross member pivots upward into recess 110 of the cover. For example, insertion of tongue bar 36 into buckle slot 47 (FIG. 4) causes projection 54 to pivot downward rocking cross member 65 atop rib 100 with end portion 115 of the cross member moving downward into recess 102 and end portion 116 of the cross member moving upwardly into cover recess 110. Insertion of the second tongue bar 49 into slot 48 causes the tongue bar to engage projection 55 forcing the projection downward and pivoting the pawl in the opposite direction atop rib 100 with both end portions 115 and 116 then being positioned out of recesses 101, 102 and 110.

Removal of a single tongue bar from the buckle allows the pawl to stay lockingly engaged with the second tongue bar remaining in the buckle. For example, pressing down actuator 41 forces projections 54 and 55 downwardly from both tongue bars allowing both tongue bars or a single tongue bar to be removed. Release of the actuator causes the pawl to move upwardly lockingly engaging any tongue bar remaining in the buckle. Instead of applying force to the center of the top surface of actuator 41, it is possible to apply downward pressure to one side of the actuator button. For example, the top surface of the actuator includes a side portion 120 and 121 (FIG. 3). For example, applying downward pressure to side portion 120, the actuator and pawl are caused to tilt thereby forcing projection 55 downwardly while projection 54 moves upwardly under the force of the spring. Simultaneously, end portion 116 of cross member 65 moves downwardly into recess 101 while end portion 115 of the cross member moves upwardly into recess 110 enabling tongue bar 49 to be removed from the buckle while tongue bar 36 remains lockingly engaged with projection 54. Release of the actuator causes the pawl to move upwardly retaining projection 54 in aperture 37 of tongue bar 36. Pawl 40 is movable to rock or pivot about rib 100 and also to pivot about the pawl cross member 65 with cross member 65 providing a hinge as the distal end 51 of the pawl moves downwardly or upwardly.

The pawl provides a means to lock the tongue bars to the pawl and eliminate any rattling noise between the pawl, buckle main body and tongue bars. Slots 47 and 48 each have a downwardly facing upper edge surface 131 and 130 that engage the upwardly facing top surface of tongue bars 36 and 49 when the tongues are lockingly engaged with the pawl. Spring 39 is operable to force the pawl upwardly to the extent that the tongue bars are forced against edges 130 and 131 thereby preventing any rattling noise between the tongues, pawl and buckle main body.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A web buckle and non-interlocking tongues combination comprising:

first and second non-interlocking tongues which have tongue bars;

a buckle housing with an entrance for insertion of said bars of said non-interlocking tongues one at a time, said housing having a bottom wall and an upwardly extending projection; said housing having a longitudinal axis extending in the direction of said bars when inserted into said housing;

an actuator movably mounted to said housing;

a locking pawl both rockable around said axis and pivotable in a direction perpendicular to said axis being mounted on said projection and engaged with said actuator, said pawl having extensions movable to a locking position to lockingly and selectively hold separately each of said tongue bars when inserted one at a time into said buckle and movable by said actuator to a release position to release selectively and separately each of said tongue bars; and, a spring contactable with said pawl normally forcing said pawl to said locking position but yieldable to allow said pawl to move to said release position.

2. The combination of claim 1 wherein:

said pawl rests atop said projection which is a rib, said pawl rocks and pivots thereon when a single one of said tongue bars is inserted into said buckle housing.

3. The combination of claim 2 wherein:

said housing has a recess allowing said pawl to rock when said actuator moves a side of said pawl.

4. The combination of claim 1 wherein:

said actuator is fixedly mounted to said locking pawl and moves in unison therewith preventing any rattling noise therebetween.

5. The combination of claim 1 wherein:

said pawl has a proximal end and a flat portion with said proximal end joined at an acute angle to said flat portion which extends parallel to said bottom wall, said pawl further has a distal end joined to said flat portion which is between said proximal end and said distal end, said proximal end rests atop and is rockable on said projection, said distal end engageable by said tongue bars to depress said pawl as said tongue bars are inserted into said buckle housing.

6. The combination of claim 5 and further comprising:

a cover mounted to said buckle housing retaining said proximal end of said pawl between said projection of said housing and said cover hingedly mounting said pawl and allowing said pawl to pivot on said projection when moved up and down by said tongue bars and said actuator.

7. The combination of claim 5 wherein:

said proximal end has a ridge formed thereon.

8. The combination of claim 7 wherein:

said actuator includes a plurality of legs extending downwardly which are fixed to said pawl.

9. The combination of claim 1 wherein:

said projection is a rib extending upwardly from said bottom wall and in the direction of said longitudinal axis, said housing further has a pair of recesses positioned on either side of said rib into which said pawl is movable as said pawl is rocked atop said rib.

10. The combination of claim 9 wherein:

said actuator is a push button which has an upwardly facing first side portion and an upwardly facing opposite second side portion, said first side portion is located above the tongue bar of said first tongue when inserted whereas said second side portion is located above the tongue bar of said second tongue when inserted, said first side portion movable downwardly tilting said pawl atop said rib in a first tilting direction around said longitudinal axis and allowing disengagement and removal of the tongue bar of said first tongue located beneath said first side portion whereas said second side portion is movable downwardly independently of said first side portion tilting said pawl atop said rib in a direction opposite of said first tilting direction allowing disengagement and removal of the tongue bar of said second tongue located beneath said second side portion.

11. The combination of claim 9 wherein:

said pawl has a proximal end and a flat portion with said proximal end joined at an acute angle to said flat portion which extends parallel to said bottom wall, said proximal end has a first edge and an opposite edge with said first edge moving into one of said pair of recesses when said pawl is tilted in one direction with said opposite edge moving into another of said pair of recesses when said pawl is tilted in a direction opposite of said one direction.

12. A buckle for lockingly and selectively engaging tongue bars of a pair of non-interlocking tongues comprising:

a buckle housing having an entrance configured to receive tongue bars of a pair of non-interlocking tongues, said housing having a longitudinal axis extending the length of said housing and in a direction in which said tongue bars are insertable therein;

a locking pawl with a pair of extensions to engage said tongue bars and hold same in said buckle housing until moved apart from said tongue bars, said pawl is mounted in said buckle housing and is tiltable around said longitudinal axis and pivotable about an axis perpendicular to said longitudinal axis allowing said tongue bars to be selectively and separately released therefrom one at a time;

an actuator mounted to said buckle housing and movable with said locking pawl to release said tongue bars from said extensions; and, a spring engaged with said locking pawl and normally urging said extensions into lockingly engagement with said tongue bars when inserted into said buckle housing but yieldable under pressure by said actuator to allow movement of said locking pawl to move said extensions selectively and separately apart from said tongue bars.

13. The buckle of claim 12 wherein:

said buckle housing has an upraised portion; and, said locking pawl has a main body with said extensions extending upwardly therefrom engageable with said tongue bars, said main body has a proximal end mounted on said upraised portion and is tiltable and pivotable thereon.

14. A buckle for lockingly and selectively engaging tongue bars of a pair of non-interlocking tongues comprising:

a buckle housing having an entrance configured to receive tongue bars of a pair of non-interlocking tongues, said housing having a longitudinal axis extending the length of said housing and in a direction in which said tongue bars are insertable therein;

a locking pawl with a pair of extensions to engage said tongue bars and hold same in said buckle housing until moved apart from said tongue bars, said pawl is mounted in said buckle housing and is tiltable around said longitudinal axis and pivotable about an axis perpendicular to said longitudinal axis allowing said tongue bars to be selectively and separately inserted therein one at a time;

an actuator, mounted to said buckle housing and movable with said locking pawl to release said tongue bars from said extensions; and, a spring engaged with said locking pawl and normally urging said extensions into lockingly engagement with said tongue bars when inserted into said buckle housing but yieldable under pressure by said actuator to allow movement of said locking pawl to move said extensions selectively and separately apart from said tongue bars.

15. The buckle of claim 14 wherein:

said buckle housing has an upraised portion; and said locking pawl has a main body with said extensions extending upwardly therefrom engageable with said tongue bars, said main body has a proximal end mounted on said upraised portion and is tiltable and pivotable thereon.

16. The buckle of claim 15 wherein:

said upraised portion is a rib extending in the direction of said longitudinal axis, said housing further has a pair of recesses positioned on either side of said rib into which said pawl is movable as said pawl is rocked atop said rib.

17. The combination of claim 16 wherein:

said actuator is a push button which has an upwardly facing first side portion and an upwardly facing opposite second side portion, said first side portion is located above the tongue bar of one tongue of said pair of tongues when inserted whereas said second side portion is located above the tongue bar of the other tongue of said pair of tongues when inserted, said first side portion movable downwardly tilting said pawl atop said rib in a first tilting direction and allowing disengagement and removal of the tongue bar of the tongue located beneath said first side portion whereas said second side portion is movable downwardly independently of said first side portion tiling said pawl atop said rib in a direction opposite of said first tilting direction allowing disengagement and removal of the tongue bar of the tongue located beneath said second side portion.

18. The combination of claim 16 wherein:

said housing has a bottom wall, said pawl has a proximal end and a flat portion with said proximal end joined at an acute angle to said flat portion which extends parallel to said bottom wall, said proximal end has a first edge and an opposite edge with said first edge moving into one of said pair of recesses when said pawl is tilted in one direction with said opposite edge moving into another of said pair of recesses when said pawl is tilted in a direction opposite of said one direction.

* * * * *